United States Patent [19]

Stropkay

[11] Patent Number: 4,659,077

[45] Date of Patent: Apr. 21, 1987

[54] EXERCISE DEVICE

[75] Inventor: Edward J. Stropkay, Chesterland, Ohio

[73] Assignee: Fitness Quest, Inc., Canton, Ohio

[21] Appl. No.: 781,668

[22] Filed: Sep. 30, 1985

[51] Int. Cl.[4] ..... A63B 69/18; A63B 23/06

[52] U.S. Cl. ..... 272/97; 272/69; 272/70

[58] Field of Search ..... 272/69, 70, 73, 131-133; 128/25 R, 25 B

[56] References Cited

U.S. PATENT DOCUMENTS

| | | | |
|---|---|---|---|
| 1,766,089 | 6/1930 | Wood | 272/69 |
| 3,941,377 | 3/1976 | Lie . | |
| 4,023,795 | 5/1977 | Pauls . | |
| 4,340,214 | 7/1982 | Schützer | 272/70 |
| 4,529,194 | 7/1985 | Haaheim | 272/69 |

OTHER PUBLICATIONS

"*Cross Country Shortcut*" Nordic Track-Edward Pauls The Washington Star/Mar. 30, 1980 p. 23.

*Primary Examiner*—Richard J. Apley
*Assistant Examiner*—S. R. Crow
*Attorney, Agent, or Firm*—Sand & Hudak Co.

[57] ABSTRACT

An exercise device for simulating cross-country skiing in which the user stands on a pair of foot plates moveably mounted on a pair of tracks extending along a base frame. A pair of endless flexible belts extends about rollers located at the front and rear of the frame and extend along the tracks beneath the foot plates. An eccentric cam is mounted on the bottom of each of the foot plates and drivingly connects the foot plate to its respective belt by clamping the belt against a bracket upon movement of the foot plate in a rearward direction and which releases the clamping engagement with the belt upon movement of the foot plate in the forward direction to simulate movement of a pair of cross-country skis. An adjustable brake provides resistances to the movement of the belts when the foot plates are moved in the rearward direction. A pair of hand manipulated tension cables are mounted on a pedestal to provide resistance to arm movement of the users to simulate operation of ski poles.

19 Claims, 12 Drawing Figures

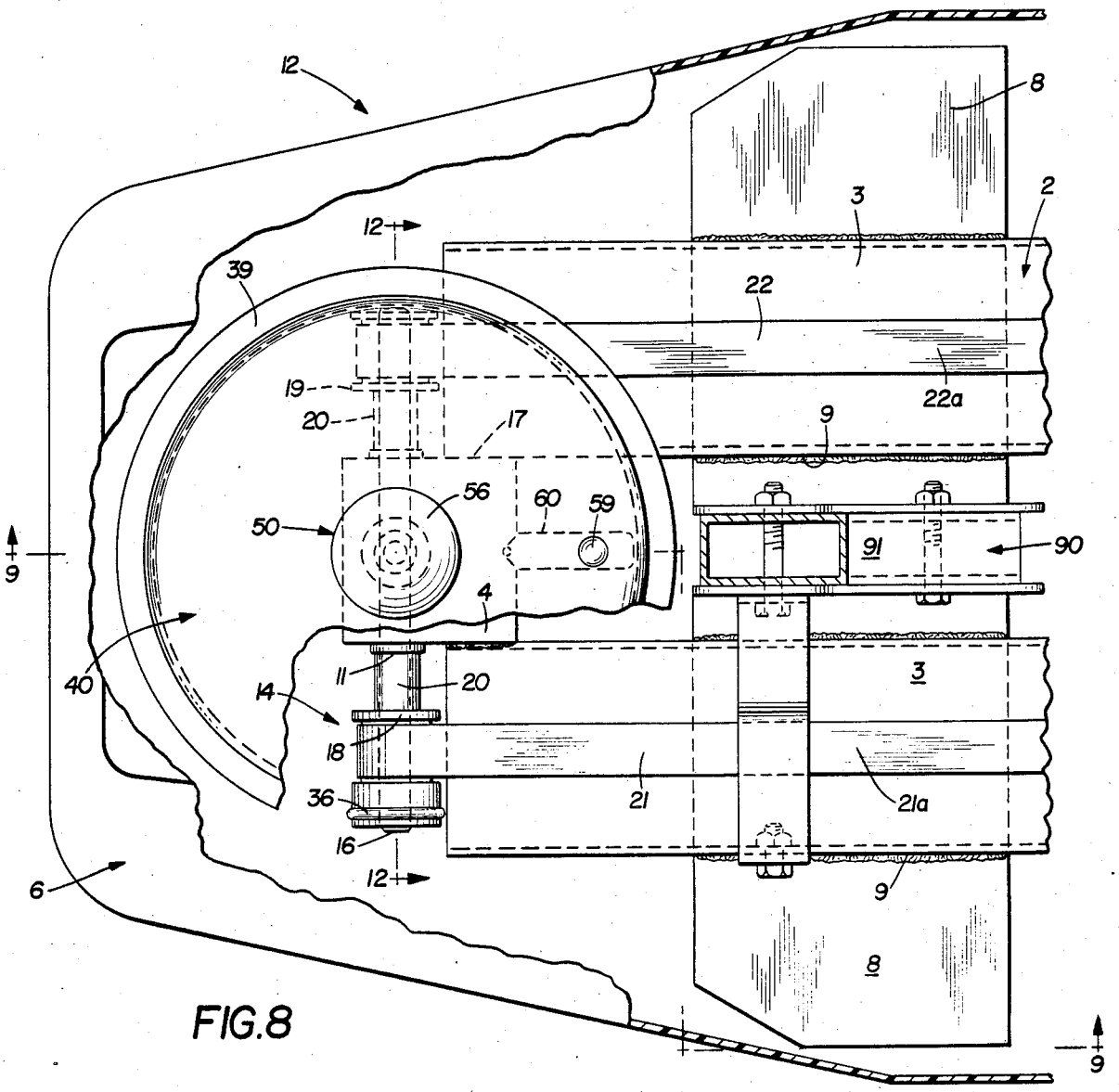
FIG.8
FIG.9
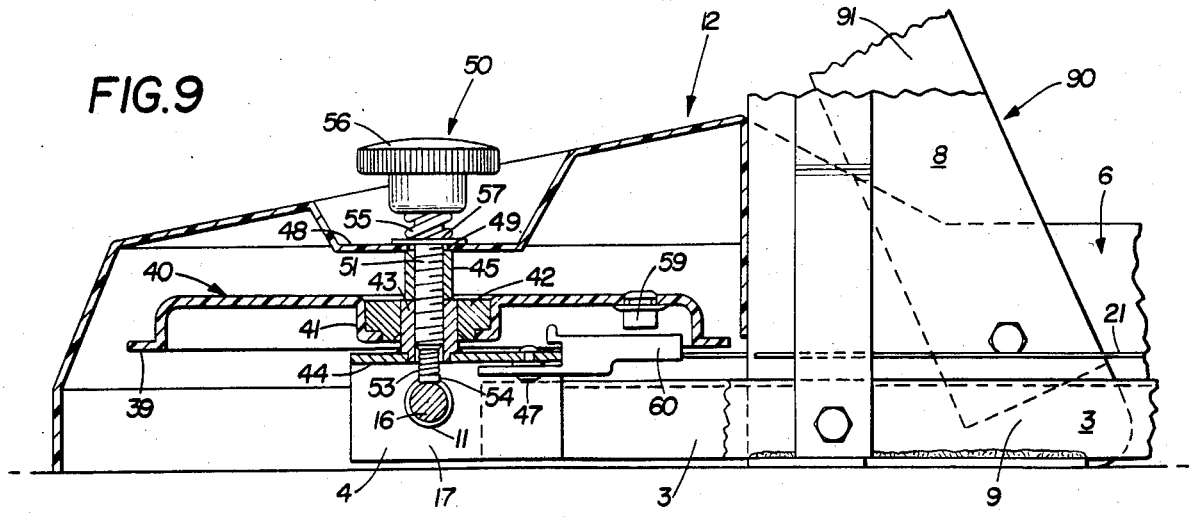

EXERCISE DEVICE

TECHNICAL FIELD

The invention relates to an exercise device and in particular to a device for simulating cross-country skiing. More particularly, the invention relates to an exercise device in which the forces and movement exerted on and carried out by a person using the device closely simulates those occuring in cross-country skiing to provide exercise and body development for the major muscle groups of the body.

BACKGROUND ART

Physical fitness and various forms of exercise has increased considerably in the past number of years as well as the use of various devices permitting exercise in a confined area such as in a gymnasium or in a basement or separate room of a dwelling. Various forms of outdoor exercise also have increased in popularity and in particular cross-country skiing. Cross-country skiing has been determined to be one of the most effective forms of exercises, both as a cardiovascular fitness exercise and for simultaneously exercising nearly every major muscle group in the body without subjecting the body to the constant jarring and the possibility of injury which sometimes results from such types of exercise. However, due to the limited time periods during which cross-country skiing can be carried out, that is when there is adequate snow, individual's wish to be in shape for skiing as soon as there is adequate snow. Also, other individual's wish to derive the physical benefits from an exercise which closely simulates the cross-country skiing without actually performing the skiing in the outdoor environment.

Various devices have been developed for indoor exercise which provide both the cardiovascular and muscular development as provided by cross-country skiing, and which simulate cross-country skiing for those who wish to develop the muscle control and stamina for performing the same during the off season or for obtaining the physical benefits. Examples of such devices are shown in U.S. Pat. Nos. 3,941,377; and 4,023,795.

Other types of indoor exercise devices have been developed which simulate down-hill type skiing such as shown in U.S. Pat. Nos. 2,274,081; 3,475,021; 3,455,550; 3,408,067; and 3,711,089. Still other types of exercise devices such as shown in U.S. Pat. Nos. 1,766,089; 3,332,683; 3,554,541; and 3,711,090 provide a treadmill effect which is good for the leg muscles and cardiovascular fitness but not the arms.

Although exercise devices of the type shown in the above two mentioned patents pertaining the cross-country skiing perform satisfactory, they require a structure which is relatively expensive, especially when the exerciser is being developed for the home market in contrast to a more expensive exerciser for use by commercial establishments such as gynasiums, health spas, etc.

Therefore the need has existed for an improved exercise device and in particular a device which simulates cross-country skiing which can be produced economically yet which provides a sturdy, durable and smooth operating device which achieves the desired results as those achieved by cross-country skiing, and which is usable within a protected environment.

DISCLOSURE OF THE INVENTION

Objectives of the invention include providing an improved exercise device which is of a compact and relatively inexpensive construction enabling it to be purchased by individuals for home use and which provides for the development of nearly every major muscle group of the body as well as providing cardiovascular benefits by closely simulating the body movements required during cross-country skiing and the resulting exercise achieved thereby. Another objective of the invention is to provide such a device in which the user stands on a pair of foot plates which are mounted for movement along a pair of tracks formed on a base platform, and in which a cam drive mechanism is mounted on each of the foot plates and clampingly engage a flexible belt associated with each track upon movement of the foot plate in the rearward direction and which disengages from the belt upon movement of the foot plate in the forward direction thereby providing the same motion and forces that a skier experiences during cross-country skiing.

Another objective is to provide such an improved exercise device in which the foot plates are freely movably mounted on the tracks by rollers and in which the drive mechanism includes eccentrically pivotally mounted rollers which clamp the flexible belts against a clamping bracket attached to the bottom of each foot plate, and in which an adjustable brake frictionally engages a shaft about which the flexible belts are trained to provide variable resistance to the movement of the foot plates by the user of the device thereby adjusting lower body resistance. Still another objective is to provide such a device in which a pedestal extends upwardly from the front end of the base platform and has a cushioned pad against which the body of the user presses to prevent the user from moving forwardly on the platform, in which a pair of hand grips are mounted on the ends of a cable wound about a pulley mounted on the pedestal to provide resistance to the arm movements of the user to simulate the effect of the forces exerted by the user on the ski poles, and in which this arm resistance is provided with variable adjustment means to regulate the amount of force required to be exerted by the userto satisfactorily operate the handgrips, and which is completely independent of the amount of resistance apply to the lower body movements.

Still another objective of the invention is to provide such an improved exercise device in which a disc is coupled to the shaft on which the belt engaging rollers are mounted, and in which magnetic pulse signaling means is mounted on the disc and is associated with a complementary pickup device for providing a signal to a visual indicating console which can be programmed to calculate the user's current speed, maximum speed, and average speed, and can also indicate total time, trip distance and similar functions. A still further objective is to provide such a device which is extremely durable and rugged in use and which provides the desired advantages in a relatively inexpensive and satisfactory manner.

These objectives and advantages are obtained by the improved exercise device of the invention, the general nature of which may be stated as including a base frame having front and rear ends and a spaced pair of parallel elongated tracks extending generally between said ends; a foot plate movably mounted on each of the tracks for reciprocating movement along said tracks; roller means rotatably mounted at each of the ends of the frame; a pair of endless flexible elements, each extending along a respective one of the tracks and about the roller means for movement about said roller means; cam means mounted on each of the foot plates and engageable with a respective one of the flexible elements for drivingly connecting the foot plate to the respective flexible element upon movement of the foot plate in a first direction and for disengaging the foot plate from said flexible element upon movement of the foot plate in an opposite second direction; and brake means for providing resistance to the movement of the flexible elements in the said first direction.

BRIEF DESCRIPTION OF THE DRAWINGS

A preferred embodiment of the invention, illustrative of the best mode in which applicant has contemplated applying the principles, is set forth in the following description and is shown in the drawings and is distinctly and particularly pointed out and set forth in the appended claims.

FIG. 8 is an enlarged fragmentary view with portions broken away and in section, of the front end portion of the base frame of the improved exercise device;

FIG. 9 is a fragmentary sectional view taken on line 9—9, FIG. 8;

Similar numerals refer to similar parts throughout the drawings.

BEST MODE FOR CARRYING OUT THE INVENTION

Figure 1:
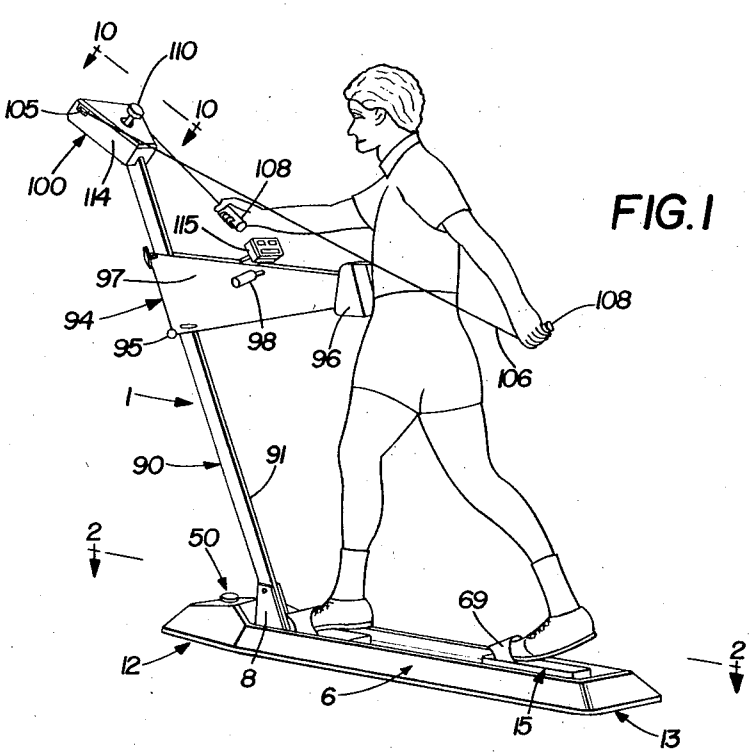
FIG. 1 is a diagrammatic perspective view showing an individual using the improved exercise device.
Figure 2:
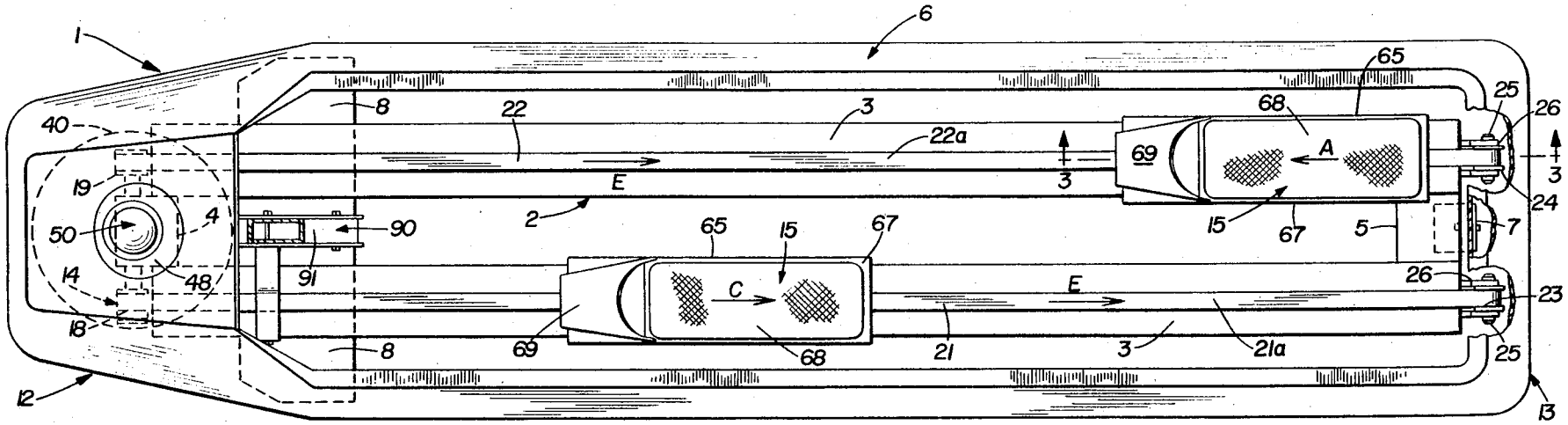
FIG. 2 is an enlarged sectional view with portions broken away taken on line 2—2, FIG. 1.
Figure 7:
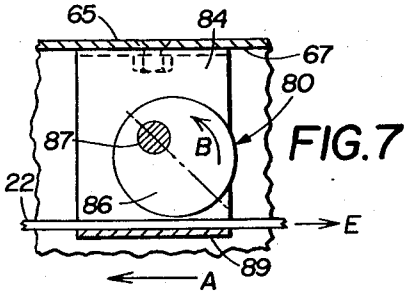
FIG. 7 is a view similar to FIG. 6 showing the eccentric cam roller in disengaged position from the drive belt.
Figure 6:
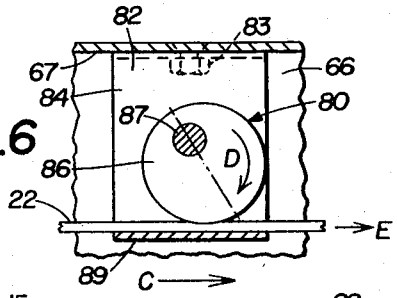
FIG. 6 is a enlarged fragmentary view of the eccentric cam roller engaging one of the drive belts operatively connecting the foot plate to the belt.
Figure 3:
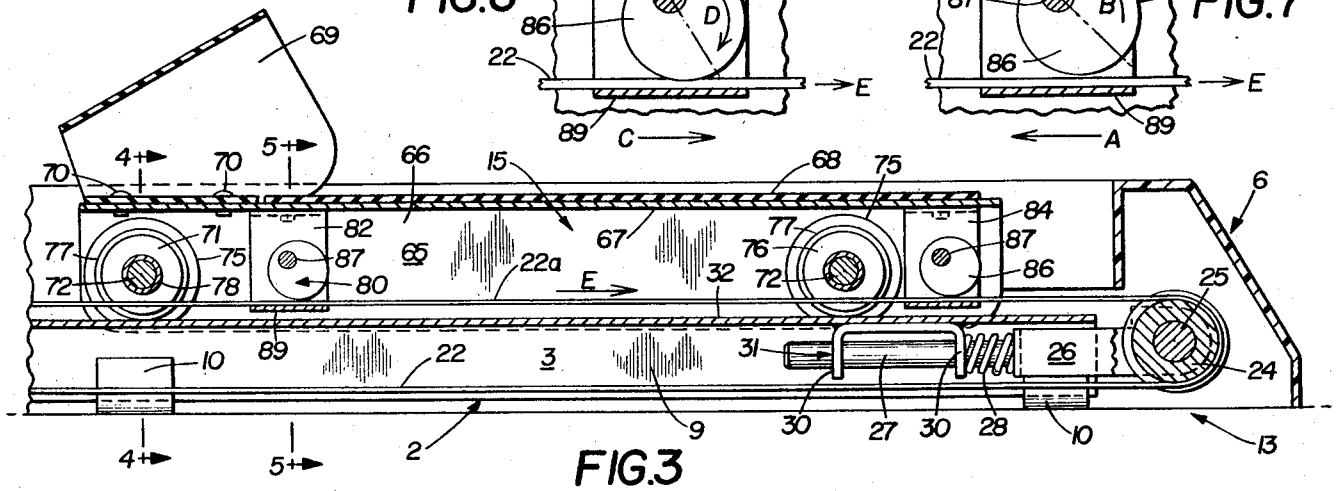
FIG. 3 is an enlarged fragmentary sectional view taken on line 3—3, FIG. 2.

The improved exercise device is indicated generally at 1, and is shown particularly in FIGS. 1, 2 and 3. Device 1 includes a main base frame or platform 2 formed by a pair of steel channels 3 connected together by front and rear channel sections 4 and 5 which are welded to the inner upstanding flange legs 9 of the channels. This arrangement forms a rigid member which is covered by high impact polymer shell 6 which conceals the base and various other components described below and provides an attractive appearance to device 1. Shell 6 is attached to base 2 by a plurality of brackets 7 only one of which is shown in FIG. 2. A flat bottom cross plate 8 is welded to the bottom of channels 3 and supports the frame on the floor or other supporting structures. A plurality of support pads 10 (FIGS. 3 and 4) are mounted in a spaced relationship along the bottoms of flange legs 9 of channels 3 and together with cross plate 8 supports the base frame on a supporting structure.

Channels 3 are spaced parallel to each other and extend generally between the front and rear ends of the base which are indicated generally at 12 and 13. Channels 3 provide a pair of tracks on which a pair of foot plates, each of which is indicated generally at 15, are movably mounted.

Referring to FIGS. 8 and 9, a roller assembly indicated generally at 14 is mounted on the front end of frame 2 and includes a main drive shaft 16 which is rotatably mounted on a main support block 17 which is attached to the front ends of channels 3. Shaft 16 extends horizontally across the front end of base 2 and has a pair of flat grooved pulleys 18 and 19 mounted in a fixed position to the outer ends of the shaft and spaced from support block 17 by a pair of spacers 20. Pulley 19 is affixed to the shaft so as to rotate with the shaft and pulley 18 may be mounted on the shaft by a one-way clutch or rigidly connected thereto.

Figure 4:
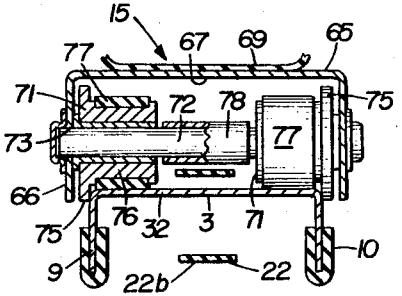
FIG. 4 is a fragmentary sectional view taken on line 4—4, FIG. 3.

In accordance with one of the features of the invention, a pair of endless flexible belts 21 and 22 extend about pulleys 18 and 19, respectively, and about a second pair of pulleys 23 and 24, each of which is mounted on an individual shaft 25 adjacent the rear end 13 of base 2. As shown in FIG. 3, each shaft 25 is rotatbly mounted on the end of a U-shaped stirup 26 which is attached to the end of a rod 27 about which a coil compression spring 28 is telescopically mounted. Each rod 27 extends through a pair of aligned holes formed in the legs 30 of a U-shaped bracket indicated generally at 31. Bracket 31 is mounted on web wall 32 of channel 3. Springs 28 are placed in a compressed position between one of the bracket legs 30 and the closed end of stirups 26, biasing pulley shafts 25 and pulleys 23 and 24 rearwardly to provide a tensioning device for flexible belts 21 and 22 which extend about the spaced pulley pairs. Belts 21 and 22 extend along U-shaped channels 3 as shown in FIGS. 2 and 3 with the upper belt sections indicated at 21*a* and 22*a* being located above channel web wall 32 with the lower belt sections 21*b* and 22*b* being located below web wall 32 (FIG. 4).

An elastomer friction ring 36 is mounted on a hub 37 which is connected to drive shaft 16 and frictionally drivingly engages an outer annular flange 39 formed on the bottom of a disc which is indicated generally at 40. Disc 40 has an annular configuration preferably formed of plastic and is formed with a recessed central area 41 having a bearing 42 pressed fitted therein. Bearing 42 is mounted on an internally threaded stub sleeve 43 which is welded to top wall 44 of support block 17. A spacer sleeve 45 is mounted on the top of stub sleeve 43 and extends through an opening 47 formed in a recessed portion 48 of the front end of shell 6.

A tensioning brake mechanism indicated generally at 50 is engaged with a roller assembly 14. Brake mechanism 50 includes a threaded shank 51 which is threadably engaged within threaded stub sleeve 43. A lower end of shank 51 is surrounded by a coil spring 53 which has a plastic button 54 attached to the end thereof which engages main drive shaft 16. A tensioning coil spring 55 surrounds the upper end of shank 51 and is compressed between a manually operated knob 56 and a washer 57. Rotation of knob 56 will cause button 54 to press against shaft 16 to provide a braking or tensioning effect thereto. Thus manual adjustment of knob 56 will regulate the amount of braking force placed on main drive shaft 16 thereby regulating the tension applied to the rotation of shaft 16 which in turns regulates the difficulty of rotating the shaft by the linear movement of drive belts 21 and 22 as described below.

A magnet 59 is mounted on disc 40 and rotates above a magnetic sensor 60 which is mounted in a fixed position on wall 44 of support block 17. Sensor 60 provides a series of pulses or electrical signals in relationship to the rotational speed of disc 40 caused by the passing of magnet 59 past sensor 60. The rotational speed of disc 40 is determined by the rotational speed of main drive shaft 16 which is drivingly frictionally coupled thereto by ring 36. Thus, the rotational speed of disc 40 is proportional to the linear movements of belts 21 and 22 which determines the rotational speed of drive shaft 16.

Referring particularly to FIGS. 2–7, each footplate 15 includes a U-shaped member 65 formed by a pair of downwardly extending end flange walls 66 and a web wall 67 which has a rubber foot tread 68 mounted on the upper surface thereof. A toe grip 69 is attached by rivets 70 on the front end of each footplate 15 providing a pocket for insertion of the front portion of a user's foot. Plate 15 is mounted for rolling movement along top walls 32 of track channels 3 by a pair of spaced wheels 71 (FIG. 4). Wheels 71 are rotatably mounted on a shaft 72 which extends through a pair of openings 73 formed in wall flanges 66. Wheels 71 each include an outer flared end 75 and a cylindrical body 76 which is covered with a resilient material 77 to provide a smooth quiet rolling engagement with track channel walls 32. Flanges 75 maintain foot plates 15 in alignment on channels 3 and prevent lateral movement of the foot plates as they move linearly along the tracks.

Figure 11:
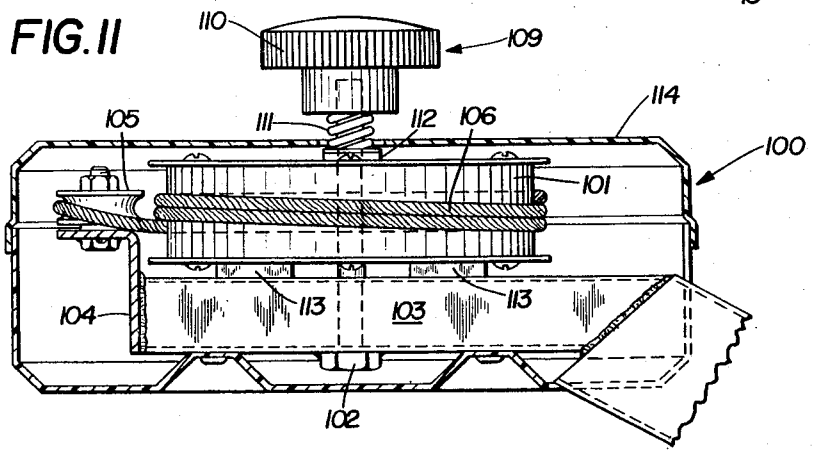
FIG. 11 is a fragmentary sectional view taken on line 11—11, FIG. 10.
Figure 10:
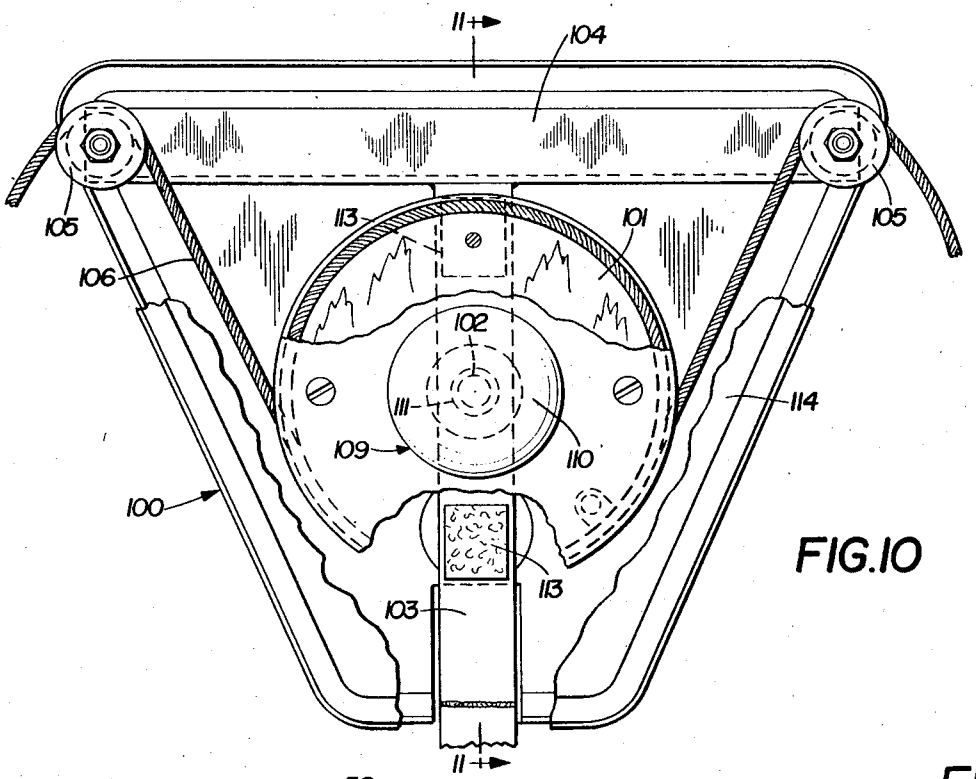
FIG. 10 is an enlarged fragmentary view with portions broken away and in section, looking in the direction of arrows 10—10, FIG. 1.
Figure 12:
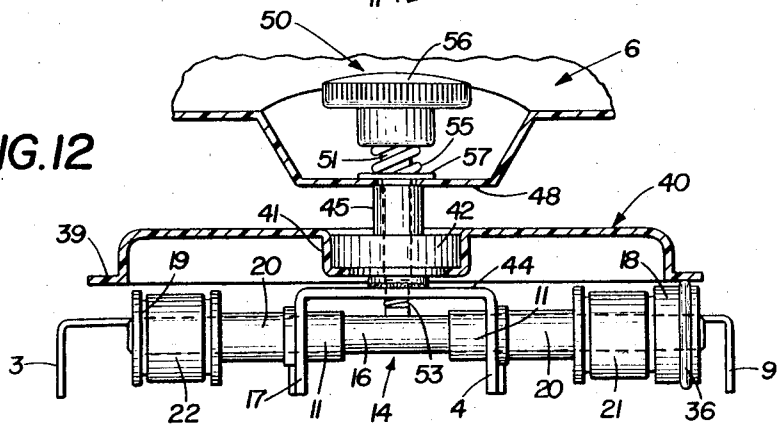
FIG. 12 is an enlarged fragmentary elevational view looking in the direction of arrows 12—12, FIG. 8.
Figure 5:
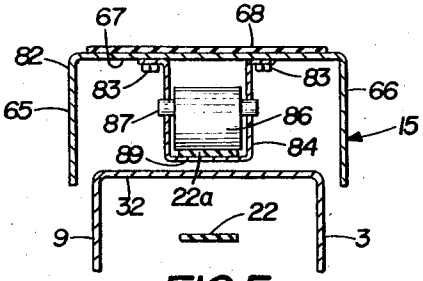
FIG. 5 is a fragmentary sectional view taken on line 5—5, FIG. 3.

In accordance with one of the main features of the invention, drive belts 21 and 22 are drivingly connected to footplates 15 by a drive mechanism indicated generally at 80 (FIGS. 3 and 5-7). Drive mechanism 80 preferably is mounted both at the front and rear portions of each footplate 15 and are similar to each other. However, if desired, a single drive mechanism 80 can be mounted on each foot plate 15 without effecting the results achieved thereby. Each drive mechanism 80 includes a U-shaped bracket 82 which is attached by bolts 83 to the bottom surface of U-shaped footplate member 65 and has a pair of spaced flanges 84 between which a cam roller 86 is eccentrically pivotally mounted by a shaft 87 (FIG. 5). Cam roller 86 is mounted so as to be engagable with the horizontal web wall 89 of bracket 82 in order to clampingly engage associated belt 21 or 22 which extends between web wall 89 of brackets 62 and the cam roller. Referring to FIGS. 1, 10 and 11, a pedestal indicated generally at 90, extends upwardly from base plateform 2. Pedestal 90 includes a main rectangular shaped tube 91 mounted on platform 2 by a U-shaped bracket 93 (FIGS. 8 and 9) which is secured to cross plate 8. A body support indicated generally at 94, is adjustably slidably mounted on pedestal tube 91 by a pin 95. Support 94 includes a cushioned pad 96 mounted on the outer end of a horizontal frame 97 to provide a restraint against which the body of the user will contact to prevent forward movement of the user as shown in FIG. 1 to enable the user to maintain the desired position on the device.

A pair of handlebar grips 98 are rigidly mounted on the sides of horizontal frame 97 and extend outwardly therefrom and are adapted to be gripped by the hands of the user should the user desire only to exercise the lower body portion and associated muscle groups and not the upper body when using device 1.

An upper body resistant and exercise assembly indicated generally at 100, is mounted on the upper end of pedestal tube 91 (FIGS. 10 and 11). Mechanism 100 includes a reel 101 which is rotationally mounted by a bolt 102 on an extension tube 103 which is welded to the end of main pedestal tube 91. An angle bracket 104 is mounted on the end of tube extension 103 and has a pair of pulleys 105 mounted on the outer ends of the bracket. A cable 106 is wrapped several times around reel 101 and then extends about pulleys 105 and has in a pair of handgrips 108 attached to the ends thereof.

A tensioning device indicated generally at 109, includes a manually adjusted knob 110 which is threadably adjustably mounted on the top of bolt 102 and has a compression coil spring 111 mounted between knob 110 and a washer 112. Washer 112 biases reel 101 downwardly toward extension tube 103 on which a pair of brake pads 113 are mounted which frictionally engage the bottom surface of reel 101 to provide resistance to the rotational movement of the reel upon reciprocating movement of the cable extensions by the user grasping and pulling on handgrips 108 as shown in FIG. 1. A housing 114 formed of a polymer material encloses the various components of assemblies 100 and tensioning mechanism 109.

An electronic console 115 is mounted on horizontal frame 97 of body support 94 and is electrically connected to magnetic sensor 60 whereby the speed of movement of disc 40 and correspondingly of foot plates 15 through belts 21 and 22 can be transmitted into a digital readout to provide various functions readily visible to the user. Console 115 preferably is mounted on frame 94 for easy viewing by the user during use of device 1. Console 115 may provide a variety of functions to the user such as a pulse meter that constantly monitors the user's heart rate by means of a small photoelectric sensor attached to the ear of the user (not shown) which picks up the pulse and relays the information to the console. The console also may have a time and distance function that enables the user to program the length of the workout and a tempo mode with a rhythmic beep to help the user keep perfect stride during the workout. Also, it can calculate current speed, maximum speed and average speed as well as indicate the total time, trip distance and total distance traveled to date by the user, all as a result of the reciprocating movement of the foot plates and correspondingly the rotational movement of disc 40.

The operation of improved exercise device 1 is as follows. A user stands on foot plates 15 placing the front part of his or her foot within toe grips 69 and grasps either fixed handle bar grips 98 or cable handgrips 108 and begins striding forwardly and rearwardly by alternating the motion on the foot plates. Upon forward motion of the foot plates, indicated by arrow A (FIGS. 2 and 7), cam rollers 86 will rotate in the direction of arrow B (FIG. 7) which will enable the foot plate to roll forwardly along their channel tracks 3 without being drivingly engaged with belts 21 and 22. Upon rearward motion of the foot plates (arrow C, FIGS. 2 and 6), cam rollers 86 will rotate in the direction of arrow D and automatically clamp belts 21 and 22 against horizontal web walls 89 of brackets 82 causing linear movement of the engaged belt rearwardly in the direction of arrow E, FIG. 3.

This belt motion will rotate main drive shaft 16 in a clockwise direction when viewing FIG. 9 and correspondingly will rotate disc 40 in its horizontal plane due to the frictional engagement with ring 36. Upon movement of the foot plates in the forward direction, the driving connection with the associated belt will disengage automatically thereby not effecting the rearward linear movement of the belts or rotational movement of drive shaft 16 and disc 40. Only the rearward movement of the foot plates will experience any resistance due to its driving engagement with the flexible belts. The amount of resistance is determined upon the setting of lower body tensioning mechanism 50 by means of knob 56 and the engagement of button 54 with shaft 16. The rotation movement of disc 40 enables the lower body movements to be transmitted through magnet 59 and magnetic sensor 60 to console 115 and calculated into a digital readout.

Upper body resistant and exercise assembly 100 enables the upper body muscle groups of the user to be exercised at the same time as the lower body muscle groups and simulates the poling of the ski poles during actual cross country skiing by the continuous up and down pulling motion on cable handgrips 108. As dicussed above, the tension on tension cable 106 can be adjusted completely independent of the tension on the lower body thereby enabling the upper and lower body muscle groups to be exercised at different resistance levels to accomodate individuals of varying upper and lower body strength, and enables the upper and lower muscle groups to be developed at different rates more closely matching the individual who is using the improved exercise device of the invention.

Accordingly the improved exercise device of the invention provides a mechanism which is extremely sturdy and durable in use, which is formed of rigid metal components and housed within an attractive high impact polymer shell in which the device closely simulates the action and forces exerted on the user that occurs during actual cross-country skiing in order to provide the cardiovascular benefit as well as the exercising of nearly all of the major muscle groups at the pace and level of ability of the individual user by adjusting the independent tensioning mechanisms on the upper and lower body mechanisms; in which the recipricating forward and rearward motion of the foot plates which simulates the movement of the skis, is drivingly connected only in the rearward motion to an associate drive belt by a unique cam roller engaging drive mechanism to provide the desired resistance as occurs in cross country skiing; and in which the device provides an extremely simple, yet rugged and efficient mechanism for achieving the desired results in contrast to the more expensive, more complicated heretofore known and used exercise device. The improved exercise device also enables various functions to be indicated on the electronic console in direct relationship to the movement of the foot plates by use of the disc and its magnetic sensing mechanism to increase the pleasure of the user and to enable the user to program his own particular exercise schedule into the console and to be constantly apprised of his progress during each specific exercise period.

Accordingly, the improved exercise device is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved exercise devie is constructed and used, the characteristics of the device, and the advantageous, new and useful results obtained; the new and useful structures, elements, arrangements, parts, and combinations, are set forth in the appended claims.

What is claimed is:

1. An exercise device including:

(a) a base frame having front and rear ends and a spaced pair of parallel elongated tracks extending generally between said ends;

(b) a foot plate movably mounted on each of the tracks for reciprocating movement along said tracks;

(c) roller means rotatably mounted at each of the ends of the frame;

(d) a pair of endless flexible elements each extending along a respective one of the tracks and about the roller means;

(e) cam means mounted on each of the foot plates and engageable with a respective one of the flexible elements for drivingly connecting the foot plate to the respective flexible element upon movement of the foot plate in a first direction and for disengaging the foot plate from said flexible element upon movement of the foot plate in an opposite second direction; and (f) brake means for providing resistance to the movement of the flexible elements in the said first direction.

2. The exercise device defined in claim 1 in which the endless flexible element is a belt formed of a plastic material.

3. The exercise device defined in claim 1 in which the cam means includes an eccentrically pivotally mounted member and a clamp bracket; and in which said member clamps the flexible element against the clamp bracket to drivingly connect the foot plate to said flexible element.

4. The exercise device defined in claim 3 in which the eccentric member is a roller.

5. The exercise device defined in claim 1 in which the foot plates are moveably mounted on the tracks by wheels.

6. The exercise device defined in claim 1 in which pedestal means is mounted on the base frame for engaging a portion of a user's body to restrain forward movement thereof.

7. The exercise device defined in claim 6 in which a hand operated flexible resistant member is mounted on the pedestal means adapted for movement by arm movements of a user.

8. The exercise device defined in claim 7 in which the flexible resistant member is a cable wound about a pulley having an adjustable tensioner engaged therewith;

and in which handgrips are mounted on ends of the cable for manipulation by a user.

9. The exercise device defined in claim 1 in which the brake means is a friction button adjustably moveable into engagement with one of the roller means by a threaded member.

10. The exercise device defined in claim 9 in which the friction button is spring biased into engagement with the roller means.

11. The exercise device defined in claim 1 in which the roller means includes a horizontal shaft extending transversely across the front end of the base frame; and in which a first pair of spaced pulleys are mounted on the shaft and are engaged by the flexible elements.

12. The exercise device defined in claim 11 in which the roller means further includes a second pair of pulleys rotatably mounted at the user end of the base frame and are engaged by the flexible elements; and in which spring means engage said second pair of pulleys for biasing said second pulleys away from the first pair of pulleys to tension the flexible elements extending therebetween.

13. The exercise device defined in claim 1 in which a disc is rotatably mounted at the front end of the base frame and is drivingly coupled with the roller means whereby rotation of the roller means will rotate the disc.

14. The exercise device defined in claim 13 including sensor means for providing signals to an indicating console in response to the rotational speed of the disc.

15. The exercise device defined in claim 14 in which the sensor means include a magnet mounted on the disc and a stationary magnetic sensor mounted on the base frame in a location adjacent a circular path followed by the magnet upon rotation of the disc.

16. The exercise device defined in claim 15 in which a pedestal extends upwardly from the base frame; in which a visual indicating console is mounted on the pedestal; and in which the signals provided by the sensor means are supplied to the console to indicate certain characteristics of the linear movement of the foot plates along the tracks.

17. The exercise device defined in claim 13 in which the roller means includes a horizontally extending shaft; in which the disc is mounted for rotation in a horizontal plane on a vertical shaft; and in which the disc is frictionally coupled with the roller means shaft to provide the driving coupled engagement therebetween.

18. The exercise device defined in claim 17 in which an elastomeric friction ring is mounted in the roller means shaft and engages the disc to provide the friction coupling engagement therebetween.

19. The exercise device defined in claim 1 in which each of the cam means includes a U-shaped bracket mounted on an underside surface of the front plate and a roller pivotally eccentrically mounted on said bracket; and in which the roller clamps the flexible element against a web wall of the U-shaped bracket when the foot plate means in the first direction.

* * * * *